US008584881B2

(12) United States Patent
Hernández

(10) Patent No.: US 8,584,881 B2
(45) Date of Patent: Nov. 19, 2013

(54) FOOD CONTAINER

(75) Inventor: José Antonio Rodriguez Hernández, Mexico City (MX)

(73) Assignees: PAC International, Inc., Auburn, WA (US); Nutrigo SA DE CV, Mexico City (MX); PAK West Paper & Packaging, Santa Ana, CA (US)

( * ) Notice: Subject to any disclaimer, the term of this patent is extended or adjusted under 35 U.S.C. 154(b) by 489 days.

(21) Appl. No.: 12/704,079

(22) Filed: Feb. 11, 2010

(65) Prior Publication Data

US 2011/0094918 A1 Apr. 28, 2011

Related U.S. Application Data

(60) Provisional application No. 61/255,753, filed on Oct. 28, 2009.

(51) Int. Cl.
*B65D 6/28* (2006.01)
*B65D 81/02* (2006.01)
*B65D 81/26* (2006.01)

(52) U.S. Cl.
USPC ..... 220/4.26; 206/521; 426/124

(58) Field of Classification Search
USPC ..... 220/4.21–4.27, 62.11, 507, 516, 517; 206/521.15, 521.1, 521, 503, 504, 507, 206/509, 445, 561, 558, 391; 426/124, 108, 426/106, 119; D09/730, 424, 425
See application file for complete search history.

(56) References Cited

U.S. PATENT DOCUMENTS

| | | | | | |
|---|---|---|---|---|---|
| 3,128,030 | A | * | 4/1964 | Davies | 229/406 |
| D201,579 | S | | 7/1965 | Weiss | |
| D204,323 | S | | 4/1966 | Bostrom | |
| D204,505 | S | | 4/1966 | Bostrom | |
| 3,288,278 | A | * | 11/1966 | Rich et al. | 426/106 |
| 3,322,267 | A | | 5/1967 | Weiss | |
| 3,372,812 | A | | 3/1968 | Parcels | |
| 3,740,238 | A | * | 6/1973 | Graham | 426/124 |
| 3,835,994 | A | * | 9/1974 | Davis et al. | 206/499 |
| D276,590 | S | | 12/1984 | Lobel | |
| 4,512,474 | A | | 4/1985 | Harding | |
| 4,576,330 | A | | 3/1986 | Schepp | |
| D283,789 | S | | 5/1986 | Kodousek et al. | |
| 4,840,276 | A | * | 6/1989 | George | 206/499 |
| D303,354 | S | * | 9/1989 | Catacchio | D9/419 |
| 5,046,659 | A | | 9/1991 | Warburton | |
| 5,145,068 | A | | 9/1992 | Schmitz et al. | |
| D329,978 | S | * | 10/1992 | Ryan | D9/415 |
| 5,232,094 | A | | 8/1993 | Fagnant et al. | |

(Continued)

*Primary Examiner* — Bryon Gehman
*Assistant Examiner* — Shawn Braden
(74) *Attorney, Agent, or Firm* — Barnes & Thornburg LLP

(57) ABSTRACT

A one piece reclosable container for circular cookies or other cookies or food articles having rounded edges that is easy to use, handle, stack, and/or transport. The container comprises a base and a lid hingedly secured together. The lid and bases define two rows of parallel tubular segments when the lid is in the closed position. Each tubular segment defines a plurality of receptacles configured to receive a plurality of the food articles arranged in a side-by-side manner. The base comprises a plurality of base receptacle members defining the receptacles. Each base receptacle member includes a plurality of base shock absorbers configured to maintain the cookies at an elevation when the container is resting on a surface. The lid comprises a plurality of lid shock absorbers and a plurality of lid receptacle members further defining the receptacles. The containers may also be stackable.

21 Claims, 5 Drawing Sheets

(56) References Cited

U.S. PATENT DOCUMENTS

| | | | | |
|---|---|---|---|---|
| 5,515,993 | A | 5/1996 | McManus | |
| 5,758,791 | A | 6/1998 | Mangla | |
| D398,227 | S | 9/1998 | Orkisz | |
| D398,525 | S | 9/1998 | Orkisz | |
| 5,860,530 | A | 1/1999 | Simmons et al. | |
| 5,950,959 | A | 9/1999 | Milliorn | |
| 5,979,687 | A | 11/1999 | Hayes et al. | |
| 6,056,138 | A | 5/2000 | Chen | |
| 6,085,930 | A | 7/2000 | Curtis | |
| D433,334 | S | 11/2000 | Hayes et al. | |
| D439,159 | S | 3/2001 | Chen | |
| D444,382 | S | 7/2001 | Hayes et al. | |
| 6,257,401 | B1 | 7/2001 | Mangla et al. | |
| D451,018 | S | 11/2001 | Chen et al. | |
| 6,349,847 | B1 | 2/2002 | Mangla et al. | |
| D458,538 | S | 6/2002 | Hayes et al. | |
| D461,123 | S | 8/2002 | Hayes et al. | |
| D467,496 | S | 12/2002 | Hayes et al. | |
| 6,561,374 | B2 | 5/2003 | Longstreth | |
| D478,282 | S | 8/2003 | Hayes et al. | |
| 6,619,481 | B2 * | 9/2003 | Merrell et al. | 206/721 |
| 6,619,501 | B2 | 9/2003 | Hayes et al. | |
| 6,644,494 | B2 | 11/2003 | Hayes et al. | |
| D490,309 | S | 5/2004 | Hayes et al. | |
| 6,845,878 | B2 | 1/2005 | Hayes et al. | |
| 6,846,533 | B2 | 1/2005 | Wu et al. | |
| 6,884,450 | B2 | 4/2005 | Wu et al. | |
| 6,886,704 | B2 | 5/2005 | Hayes et al. | |
| 6,893,694 | B2 | 5/2005 | Wu et al. | |
| 7,124,910 | B2 | 10/2006 | Nordland | |
| D531,501 | S | 11/2006 | Gomoll et al. | |
| D531,502 | S | 11/2006 | Gomoll et al. | |
| D58,893 | S | 3/2009 | Bailey et al. | |
| D589,429 | S | 3/2009 | Harrison | |
| 2001/0002298 | A1 * | 5/2001 | Leung et al. | 429/9 |
| 2005/0189350 | A1 | 9/2005 | Hayes et al. | |
| 2005/0247708 | A1 | 11/2005 | Golden | |

* cited by examiner

FOOD CONTAINER

CROSS REFERENCE TO RELATED APPLICATIONS

This application claims priority from U.S. Provisional Patent Application 61/255,753 filed Oct. 28, 2009.

The present disclosure relates to a recloseable container for storing, displaying and/or transporting cookies or other food products.

BACKGROUND OF THE INVENTION

Containers for cookies or other food products are currently manufactured by thermoforming polystyrene or other plastic material. Because of the nature of such containers and the fragileness, breakability and crushability of the cookies or other food products, there are challenges in constructing a container that can be used in high volume production, handling, and transportation of such containers.

SUMMARY OF THE INVENTION

The present disclosure is directed to a one piece reclosable container for circular cookies or other cookies or food products having rounded edges that is easy to use, handle, stack, and/or transport. The container comprises a base and a lid hingedly secured together. The lid and bases define two rows of parallel tubular segments when the lid is in the closed position. Each tubular segment defines a plurality of receptacles configured to receive a plurality of food articles arranged in a side-by-side manner. The base comprises a plurality of base receptacle members defining the receptacles. Each base receptacle member includes a plurality of base shock absorbers configured to maintain the cookies at an elevation when the container is resting on a surface. The lid comprises a plurality of lid receptacle members further defining the receptacles and a plurality of lid shock absorbers. The containers may also be stackable. The container may be constructed of thermoplastic.

Features and advantages of the disclosure will be set forth in part in the description which follows and the accompanying drawings described below, wherein an embodiment of the disclosure is described and shown, and in part will become apparent upon examination of the following detailed description taken in conjunction with the accompanying drawings.

BRIEF DESCRIPTION OF THE DRAWINGS

The present invention and the advantages thereof will become more apparent upon consideration of the following detailed description when taken in conjunction with the accompanying drawings.

DETAILED DESCRIPTION

Figure 1:
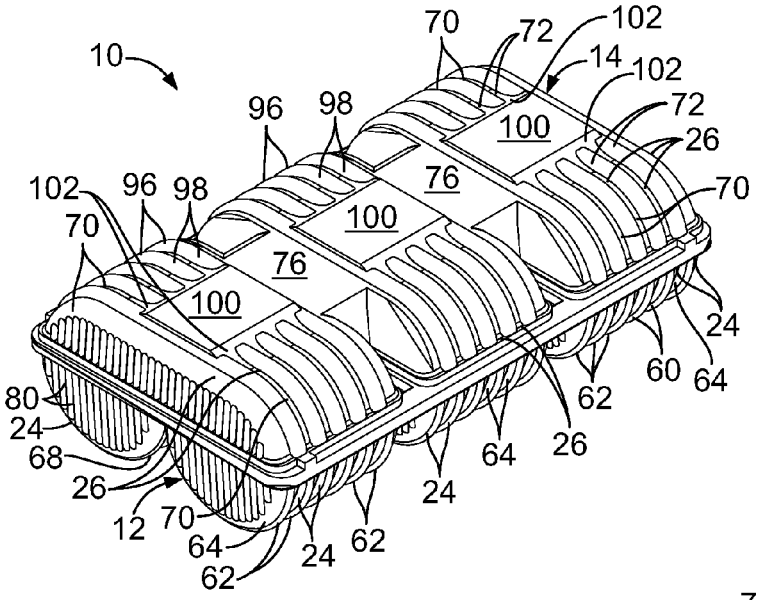
FIG. 1 is a perspective view of a thermoplastic container for cookies or other food products in accordance with an illustrated embodiment of the present disclosure, illustrating the container in a closed position.

While the present disclosure may be susceptible to embodiment in different forms, there is shown in the drawings, and will be described herein in detail, one or more embodiments with the understanding that the present description is to be considered an exemplification of the principles of the disclosure and is not intended to be exhaustive or to limit the disclosure to the details of construction and the arrangements of components set forth in the following description or illustrated in the drawings.

Figure 2:
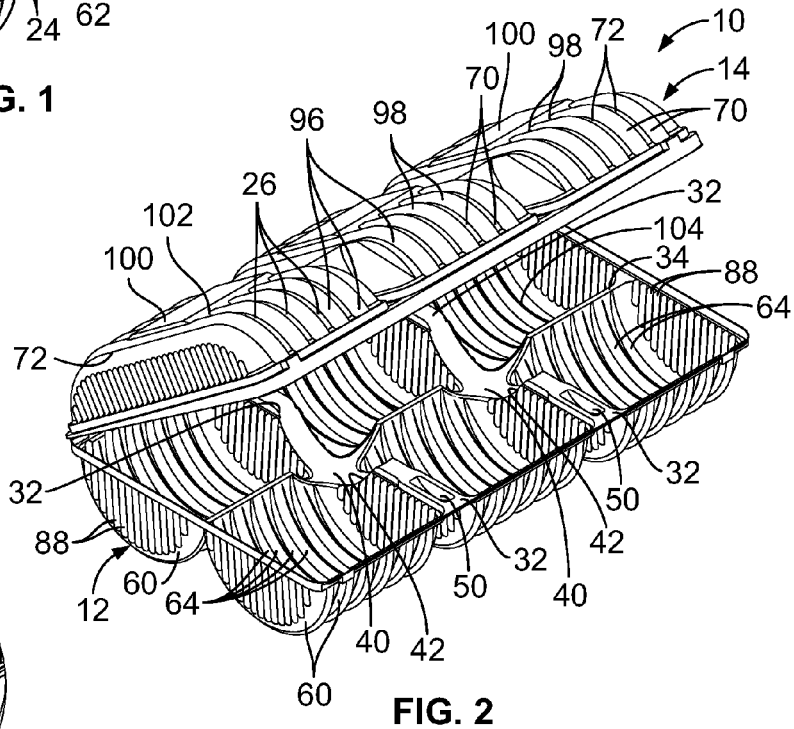
FIG. 2 is a perspective view of the container of FIG. 1, illustrating the container in a partially open position.
Figure 3:
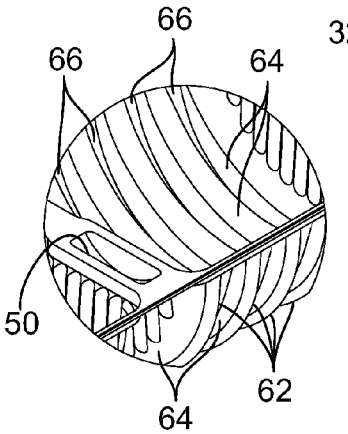
FIG. 3 is an enlarged view of Detail 3 of FIG. 2, illustrating the dividers and the shock absorbers of the base of the container.
Figure 4:
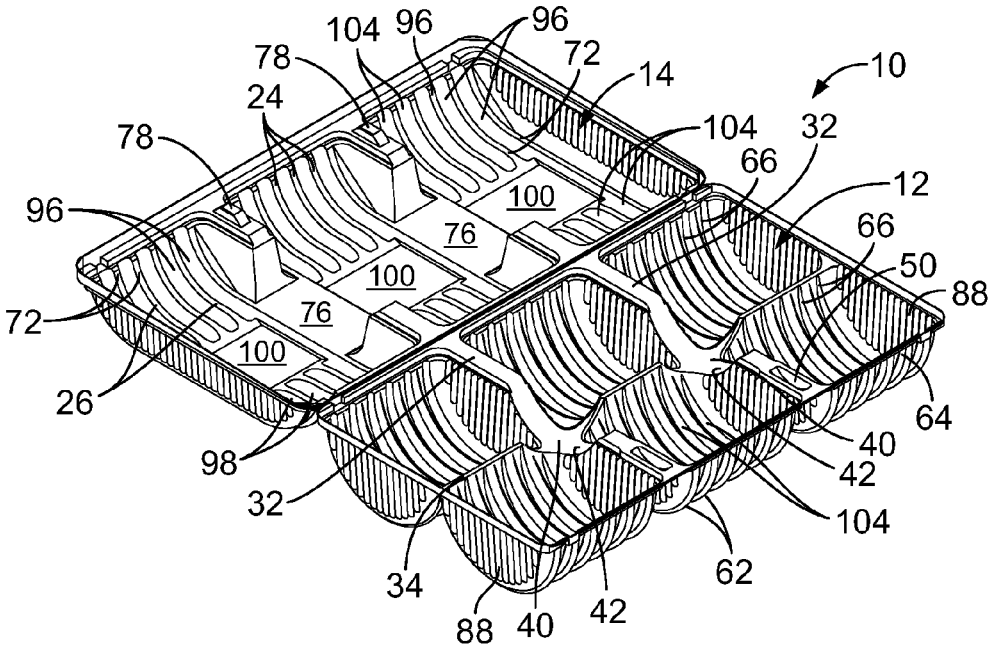
FIG. 4 is a perspective view of the container of FIG. 1, illustrating the container in an open position.
Figure 5:
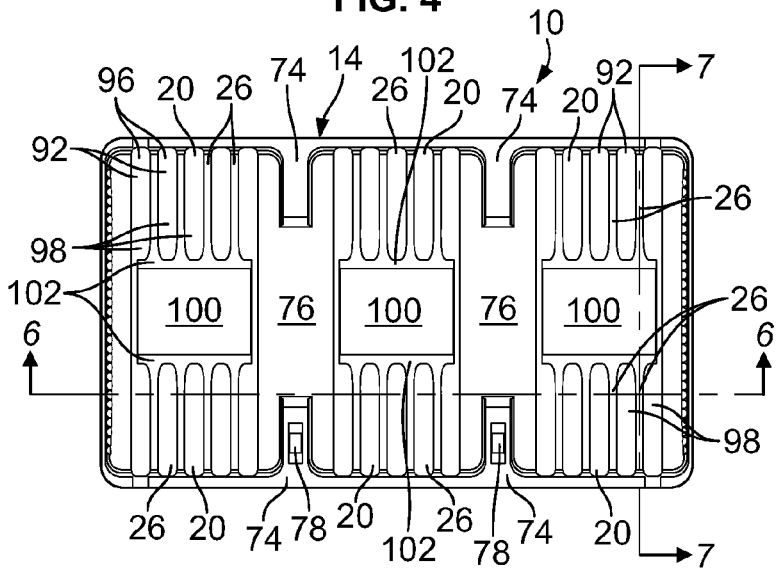
FIG. 5 is a top plan view of the container of FIG. 1.
Figure 6:
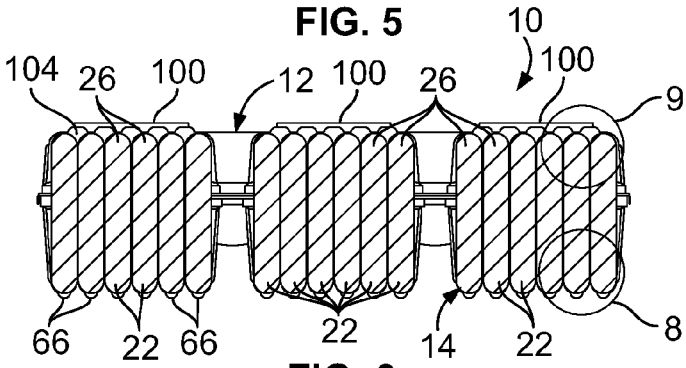
FIG. 6 is a sectional view taken along the lines 6-6 of FIG. 5.
Figure 7:
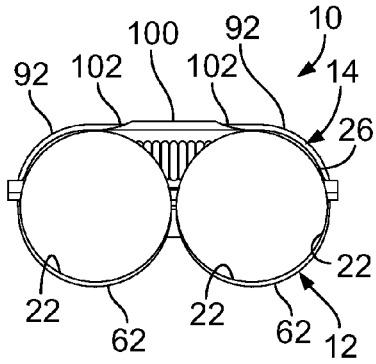
FIG. 7 is a sectional view taken along the lines 7-7 of FIG. 5.
Figure 8:
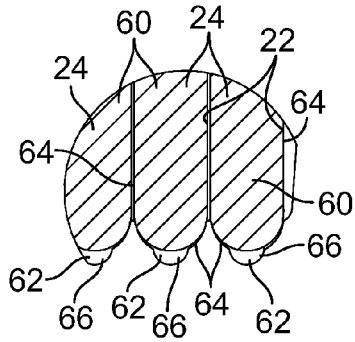
FIG. 8 is an enlarged view of Detail 8 of FIG. 6, illustrating the dividers and the shock absorbers of the base of the container.
Figure 9:
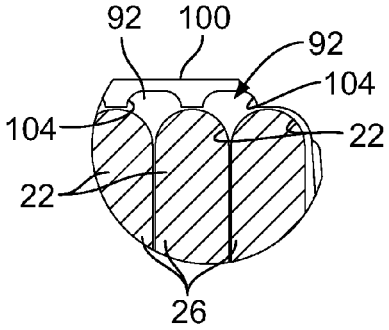
FIG. 9 is an enlarged view of Detail 9 of FIG. 6, illustrating the localizers and shock absorbers of the lid of the container.
Figure 10:
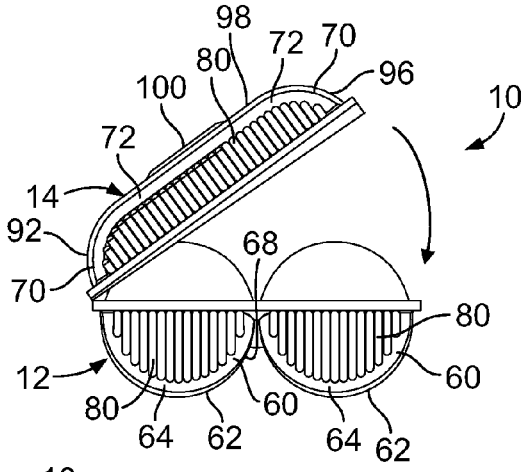
FIG. 10 is an end view of the container of FIG. 1, illustrating the container, filled with cookies, and the lid being moved to the closed position.
Figure 11:
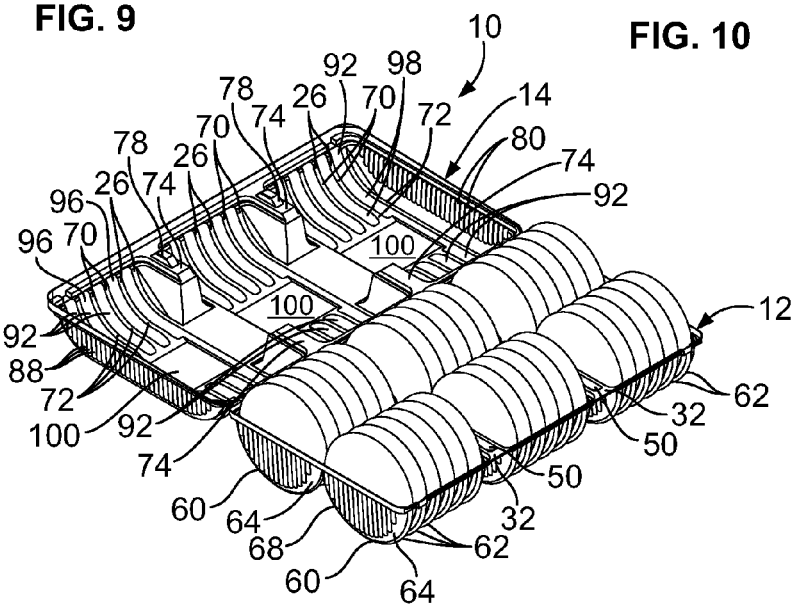
FIG. 11 is a perspective view of the of the container and cookies of FIG. 10, illustrating the container in the open position.
Figure 12:
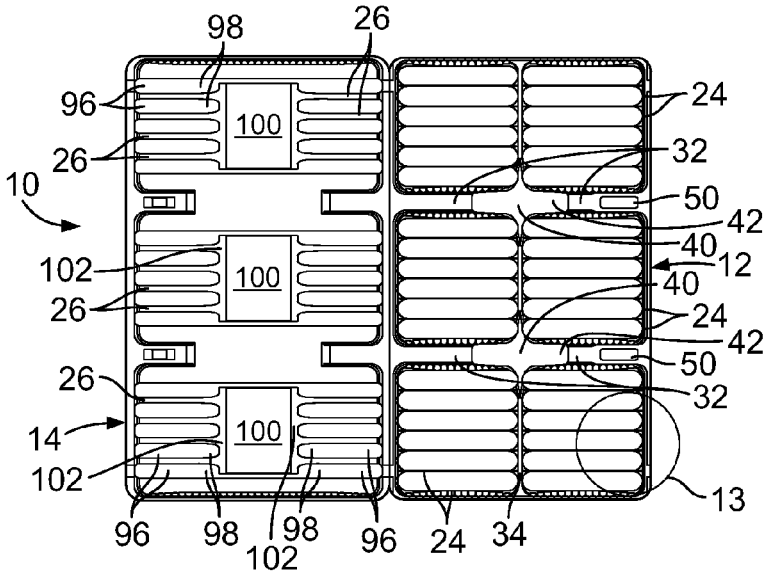
FIG. 12 is a open top plan view of the container and cookies of FIG. 10.
Figure 13:
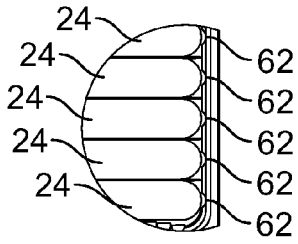
FIG. 13 is an enlarged view of Detail 13 of FIG. 12.
Figure 14:
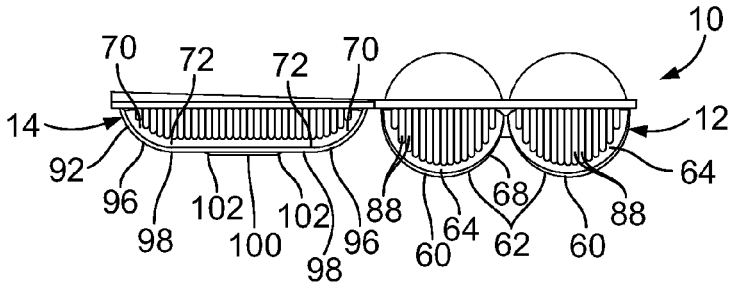
FIG. 14 is a side plan view of the cookies and container of FIG. 12.
Figure 15:
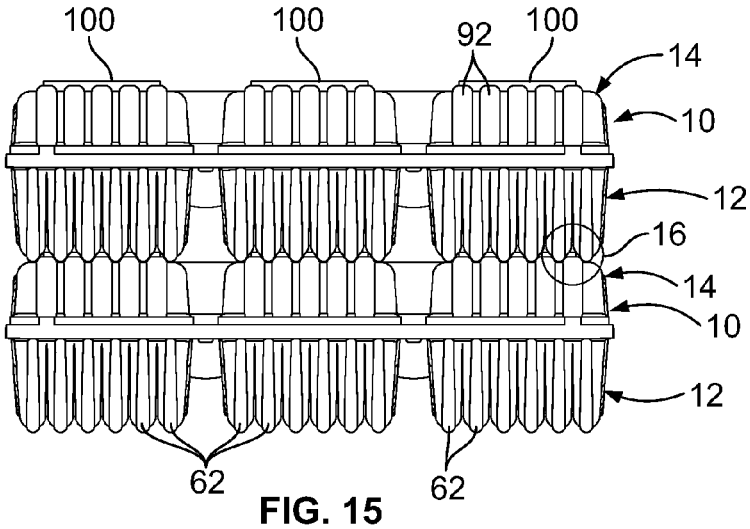
FIG. 15 is a front plan view of a pair of the containers of FIG. 1 stacked together.
Figure 16:
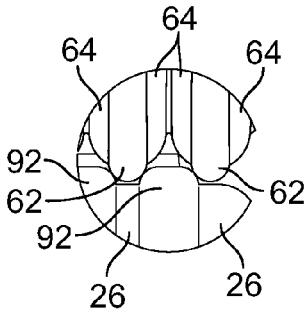
FIG. 16 is an enlarged view of Detail 16 of FIG. 15, illustrating the mating of the shock absorbers of the base of the top container with the shock absorbers of the lid of the bottom container.
Figure 17:
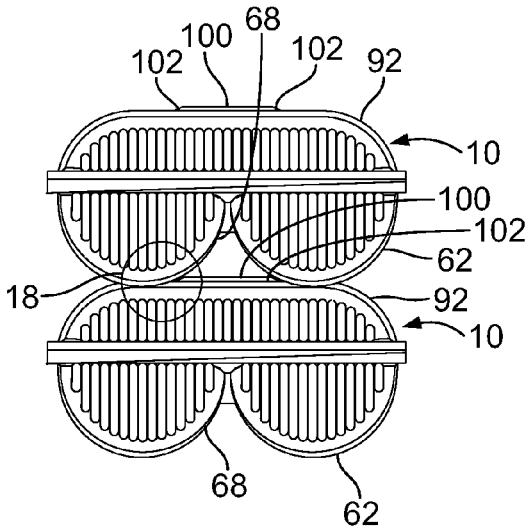
FIG. 17 is an end plan view of the containers of FIG. 15.
Figure 18:
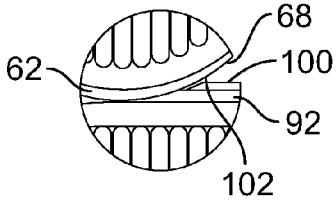
FIG. 18 is an enlarged view of Detail 18 of FIG. 17, illustrating the shock absorbers of the base of the top container mating with the nesting ridges and the shock absorbers of the lid of the bottom container.

FIGS. 1-14 illustrate a container 10 in accordance with an embodiment of the present disclosure comprising a recloseable thermoplastic container 10 including a base 12 and a lid 14 connected by a hinge 16. The lid 14 is pivotal between open and closed positions to open and close the container 10. The base and lids 12 and 14 form two rows of tubular segments 20. Each row of tubular segments 20 comprises three tubular segments 20 positioned in a side-by-side manner. Each tubular segment 20 defines six receptacles 22, each for receiving a circular cookie or other cookie or food item having a rounded edge. The base includes a plurality of base receptacle members 24 and the lid includes a plurality of lid receptacle members defining the tubular segments 20. When the lid is pivoted to the open position the container 10 and the tubular segments 20 are open and when the lid is pivoted to the closed position the container 10 and tubular segments 20 are closed. FIGS. 15-18 illustrate a pair of the containers stacked together.

The base 12 of container 10 comprises two parallel rows of the base receptacle members 24 forming the two rows of three tubular segments 20 and defining the receptacles 22. Each row comprises three sections of six base receptacle members 24 positioned in a side-by-side manner. The sections of base receptacle members 24 in each row are interconnected by two pairs of ledges 32, and the two rows are interconnected by ledge 34. The ledges 32 and 34 and the base receptacle members 24 form a bubble 40 defining a void 42 for providing easier access to the contents of the container 10 when the container is open. The front pair of ledges 32 also defines a female latch receptacle 50 for latching together the base and lid 12 and 14. A pair of latching depressions are disposed on opposite sides of the receptacle 50.

Each base receptacle member 24 comprises two rows of arcuate portions 60, each of which includes a base shock absorber 62. The arcuate portions 60 and the base shock absorber 62 extend about 180 degrees. Each arcuate portion 60 comprises a pair of shells 64 interconnected by a respective base shock absorber 62 for supporting a food article. Each base shock absorber 62 is in the form of a rib having a U-shaped cross section. Each base shock absorber 62 extends coaxial with, and radially outward beyond, the shells 64 the entire arcuate length of the shells. Each base shock absorber 62 defines a U-shaped channel 66 along its length. The base shock absorbers 62 extend arcuately at a greater radius than the shells 64 so that when the base shock absorbers 62 are resting on a surface, the food articles in the container 10 are maintained at an elevation relative to the surface. In addition to supporting the food articles, the shells 64 form dividers inside the container to separately form the receptacles 22 and to keep the cookies in spaced position in the receptacles. The base receptacle members 24 also define a void 68 to facilitate nesting of a pair of the containers 10 as described below.

The lid 14 comprises two parallel rows of the lid receptacle members 26 forming with the base receptacle member 24 the two rows of three tubular segments 20 defining the receptacles 22. Each row comprises three sections of six lid receptacle members 26. Each of the lid receptacle members 26 has an arcuate portion 70 and a linear portion 72 extending tangentially therefrom. The linear portions 72 of the end lid receptacle members 24 of each parallel pair of tubular segments 20 extend substantially the entire width of the container 10. The adjacent sections of lid receptacle members 26 are interconnected by such linear portions, by two pairs of ledges 74, and by a pair of bridges 76. The front pair of ledges 74 includes a pair of male latches 78 including a pair of lips for engaging the depressions of the latch receptacle 50. The end base and lid receptacle members 24 and 26 of each section of tubular segments 20 includes a plurality of uniformly spaced stiffening wall ribs 88.

The lid portion 14 also includes a plurality of shock absorbers 92. In each tubular segment 20, each of the lid shock absorbers 92 is disposed between a pair of the lid receptacle members 26. Each of the lid shock absorbers 92 has an arcuate portion 96 and a linear portion 98 extending tangentially therefrom. The arcuate portions 96 of the lid shock absorbers 92 coaxial with the arcuate portions 80 of the lid receptacle members 26 and extending at a greater radius than the arcuate portion 80 of the lid receptacle members 26. Each lid shock absorber 92 is in the form of a rib having a generally U-shaped configuration, with the base of the "U" being flatter and wider than that of the base shock absorber 62. Each lid shock absorber defines a U-shaped 104 channel along its length. Each lid shock absorber protects the food articles when the lid 14 impacts other structures.

The lid 14 also includes three nesting ridges 100 for nesting with another container 10. Each nesting ridge 100 includes a flat surface elevated relative to the lid shock absorbers 92 and disposed between a pair of inclined portions 102. The linear portions 72 and 98 of the lid receptacle members 26 and the lid shock absorbers 92 terminate at the inclined portions 102 (except that the linear portions 72 and 98 of the end lid receptacle members 26 and lid shock absorbers 92 may extend the width of the container 10).

The containers 10 are readily stackable one on top of another. The nesting ridges 100 of a bottom container 10 are received by the void 68 defined by the base receptacle members 24 of a top container 10. The base shock absorbers 62 of the top container 10 engage the inclined portions 102 of the nesting ridges 100 of the bottom container 10 to provide additional stability. Additionally, the base shock absorbers 62 of the top container 10 matingly engage the lid shock absorbers 92 of the bottom containing 10.

The illustrated embodiment provides many advantages. For example, the illustrated container 10 is easy to use, handle, stack, and transport, and provides individual protection to the cookies or other food products because of the base and lid shock absorbers 62 and 92. The shells 64 of the base 12 protect and organize the food products, and eliminates or minimizes contact between food articles and, as a result, prevents damage from contact. In addition, the base and lid shock absorbers 62 and 92 help to absorb impact during production, handling and transportation of the product. The shells 64 and the base and lid shock absorbers 62 and 92 provide a perfect fit for the product and also help to distribute the weight uniformly along the whole container.

The function of the base and lid shock absorbers 62 and 92 is to absorb the deformations of the container 10 during the process of packing, handling, and transportation. This feature helps to keep each cookie or other good elevated and therefore more protected from damage from impact. The shells allow the cookie or other good to stay straight up in its position to avoid contact with neighboring cookie or other good. This feature helps to prevent damage from contact. The containers provide ready visibility of the contents. The containers are also readily stackable.

The container 10, including the base 12 and the lid 14, may have any other suitable construction and configuration that includes one or more of these benefits in accordance with other embodiments of the present disclosure. For example, the container 10 can instead define more or less than two rows of tubular segments 20, and each tubular segment can have more or less than six receptacles 22 in accordance with other embodiments of the present disclosure. Further, each of the base 12 and the lid 14 may have any other suitable construction in accordance with other embodiments of the present disclosure.

While embodiments have been illustrated and described in the drawings and foregoing description, such illustrations and descriptions are considered exemplary and not restrictive in character, it being understood that only illustrative embodiments have been shown and described and that all changes and modifications that come within the spirit of the invention are desired to be protected. There are a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure.

What I Claim:

1. A one piece reclosable packaging container for food articles having a rounded edge, the container comprising:

a base and a lid hingedly secured together such that the lid is pivotal between open and closed positions, the base having a plurality of base receptacle members including a plurality of base shock absorbers and a pair of shells for supporting the food articles, the lid having a plurality of lid receptacle members and a plurality of lid shock absorbers, the base and lid receptacle members forming a pair of parallel tubular segments when the lid is in the closed position, each tubular segment defining a plurality of receptacles configured to receive a plurality of food articles arranged in a side-by-side manner, each base shock absorber comprising a rib that extends arcuately at a radius and has a U-shaped cross section, the rib configured to maintain the pair of shells at an elevation above a surface when the base shock absorbers rest on the surface;

each of the lid shock absorbers comprising a rib having an arcuate portion and a linear portion, the linear portion extending tangentially from the arcuate portion, the rib having a U-shaped cross section and configured to provide structure to protect the food articles from impact to the lid shock absorbers;

the container being stackable with an other container having a substantially identical construction, the lid shock absorbers and the lid receptacle members of the container being matingly engageable with the base shock absorbers and base receptacle members of the other container;

wherein the lid of the container includes a nesting ridge disposed between the pair of tubular segments and wherein the base receptacle members and the base shock absorbers define a void, the nesting ridge of the container received by the void of the other container; and wherein the nesting ridge includes a pair of inclined surfaces, each inclined surface adjacent a corresponding one of the tubular segments, the inclining surface engageable with the base shock absorbers of the other container.

2. A one piece reclosable packaging container for food articles having a rounded edge, the container comprising:

a base and a lid hingedly secured together such that the lid is pivotal between open and closed positions, the base having a plurality of base receptacle members including a plurality of base shock absorbers and the lid having a plurality of lid receptacle members and a plurality of lid shock absorbers, the base and lid receptacle members forming a pair of parallel tubular segments when the lid is in the closed position, each tubular segment defining a plurality of receptacles configured to receive a plurality of food articles arranged in a side-by-side manner;

each base receptacle member also including a pair of shells for supporting a respective food article and for defining a respective receptacle, a respective base shock absorber disposed between the pair of shells, each of the shells extending arcuately at a radius and each of the base shock absorbers extending arcuately at a radius greater than the radius of the shells, the base shock absorbers configured to rest on a surface and maintain the pair of shells at an elevation relative to the surface; and each lid receptacle member having an arcuate portion extending at a radius and each of the lid shock absorbers having an arcuate portion extending at a radius greater than the radius of the arcuate portions of the lid receptacle members, each of the lid shock absorbers disposed between an adjacent pair of lid receptacle members, each of the lid receptacle members being aligned with a respective one of the base receptacle members when the lid is in the closed position defining the respective receptacle.

3. The container of claim 2 wherein each base shock absorber has a U-shaped cross section, defining a U-shaped channel.

4. The container of claim 2 wherein each lid shock absorber has a U-shaped cross section, defining a U-shaped channel.

5. The container of claim 2 wherein each of the base receptacle members has a perimeter that extends about 180 degrees.

6. The container of claim 2 wherein each of the pair of shells and the base shock absorbers has a perimeter that extends about 180 degrees.

7. The container of claim 2 wherein each of the lid receptacle members includes a linear potion extending tangentially from the arcuate portion of the lid receptacle member, and each of the lid shock absorbers includes a linear portion extending tangentially from the arcuate portion of the lid shock absorber.

8. The container of claim 2 stackable with an other container having a substantially identical construction and wherein the lid shock absorbers and the lid receptacle members of the container are matingly engageable with the base shock absorbers and base receptacle members of the other container.

9. The container of claim 8 wherein the lid of the container includes a nesting ridge disposed between the pair of tubular segments and wherein the base receptacle members and the base shock absorbers define a void, the nesting ridge of the container received by the void of the other container.

10. The container of claim 9 wherein the nesting ridge includes a pair of inclined surfaces, each inclined surface adjacent a corresponding one of the tubular segments, the inclining surface engageable with the base shock absorbers of the other container.

11. The container of claim 2 comprising a plurality of pairs of parallel tubular segments forming two rows of the tubular segments.

12. The container of claim 11 wherein the lid includes latch structure and the base includes mating latch structure between the adjacent tubular segments.

13. A one piece reclosable packaging container for food articles having a rounded edge, the container comprising:

a base and a lid hingedly secured together such that the lid is pivotal between open and closed positions, the base having a plurality of base receptacle members including a plurality of base shock absorbers and the lid having a plurality of lid receptacle members and a plurality of lid shock absorbers, the base and lid receptacle members forming two rows of three tubular segments when the lid is in the closed position, each tubular segment defining a plurality of receptacles configured to receive a plurality of food articles arranged in a side-by-side manner;

each base receptacle member further including a pair of shells for supporting a respective food article and for defining a respective receptacle, a respective base shock absorber disposed between the pair of shells, each of the shells extending arcuately at a radius and each of the base shock absorbers extending arcuately at a radius greater than the radius of the shells, the base shock absorbers configured to rest on a surface and maintain the pair of shells at an elevation relative to the surface; and each lid receptacle member having an arcuate portion extending arcuately at a radius and each of the lid shock absorbers having an arcuate extending arcuately at a radius greater than the radius of the arcuate portions of the lid receptacle members, each of the lid shock absorbers disposed between an adjacent pair of lid receptacle members, each of the lid receptacle members being aligned with a respective one of the base receptacle members when the lid is in the closed position defining the respective receptacle.

14. The container of claim 13 wherein each base shock absorber has a U-shaped cross section, defining a U-shaped channel.

15. The container of claim 13 wherein each lid shock absorber has a U-shaped cross section, defining a U-shaped channel.

16. The container of claim 13 wherein there are two rows of three sections of base receptacle members and there are two rows of three sections of lid receptacle members forming the two rows of three tubular segments.

17. The container of claim 16 wherein the base further comprises ledges separating the tubular segments in each row, the lid comprises ledges separating the tubular segments in each row, and the ledges of the base includes a pair of latch structures and the ledges of the lid include latch structures that engage the latch structures of the ledges of the base.

18. The container of claim 13 further comprising a bubble defining a void to facilitate access to food articles disposed within the receptacles.

19. The container of claim 13 stackable with an other container having a substantially identical construction.

20. The container of claim 19 wherein the lid shock absorbers and the lid receptacle members of the container are matingly engageable with the base shock absorbers and base receptacle members of the other container and wherein the lid of the container includes a nesting ridge separating the rows of tubular segments and wherein the base receptacle members and the base shock absorbers define a void, the nesting ridge of the container received by the void of the other container.

21. The container of claim 20 wherein the nesting ridge includes a pair of inclined surfaces engageable with the base shock absorbers of the other container.

* * * * *